US005228281A

United States Patent [19]

Stahlecker

[11] Patent Number: 5,228,281

[45] Date of Patent: Jul. 20, 1993

[54] ARRANGEMENT AND METHOD FOR FALSE-TWIST SPINNING

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany; a part interest

[21] Appl. No.: 864,199

[22] Filed: Apr. 3, 1992

Related U.S. Application Data

[63] Continuation of Ser. No. 606,083, Oct. 30, 1990, abandoned.

[30] Foreign Application Priority Data

Nov. 4, 1989 [DE] Fed. Rep. of Germany ..... 3936803

[51] Int. Cl.[5] ..... D01M 5/28; D02G 1/04

[52] U.S. Cl. ..... 57/328; 57/315; 57/333

[58] Field of Search ..... 57/328, 333, 401, 90, 57/315, 408, 411

[56] References Cited

U.S. PATENT DOCUMENTS 4,583,355 4/1986 Vigon ..... 57/328 X
4,584,830 4/1986 Faure et al. ..... 57/6 X
4,724,668 2/1988 Wassenhoven ..... 57/400
4,953,349 9/1990 Fehrer ..... 57/315
5,090,192 2/1992 Stahlecker ..... 57/328

FOREIGN PATENT DOCUMENTS 3714212 11/1988 Fed. Rep. of Germany .
8509974 12/1986 France ..... 57/401
2215743 9/1989 United Kingdom ..... 57/90

*Primary Examiner*—Daniel P. Stodola
*Assistant Examiner*—William Stryjewski
*Attorney, Agent, or Firm*—Evenson, McKeown, Edwards & Lenahan

[57] ABSTRACT

An arrangement for pneumatic false-twist spinning having a drafting unit, a false-twisting device which follows, having a connected withdrawal device and having a rotation body arranged between the false-twisting device and the drafting unit. It is provided that the rotation body is arranged directly behind the pair of delivery rollers of the drafting unit in such a manner that its suction device is effective into the area of the nip line of the pair of delivery rollers of the drafting unit. A suction slot of the rotation body has a section which extends essentially in the direction of the nip line and is situated in the area of a deflection of the sliver leaving the pair of delivery rollers.

34 Claims, 10 Drawing Sheets

ARRANGEMENT AND METHOD FOR FALSE-TWIST SPINNING

This is a continuation of application Ser. No. 07/606,083, filed Oct. 30, 1990, now abandoned.

BACKGROUND AND SUMMARY OF THE INVENTION

The invention relates to an arrangement for false-twist spinning having a drafting unit, having a false-twisting device which follows, having a connecting withdrawal device, and having a drivable rotation element which is connected in front of the false-twisting device and which is provided with an air-permeable shell surface. The air permeable shell surface is subjected from the interior to suction by means of a suction device having a suction slot. The axis of rotation of the rotation element is directed essentially perpendicularly with respect to a plane extending through a nip line of a pair of delivery rollers of the drafting unit.

In a known arrangement of the initially mentioned type disclosed in German Patent Document DE-A 37 14 212, two rotation bodies are provided, the yarn travelling between them. The yarn is alternately pulled to these rotation bodies promoting the spreading-away of fibers from the fiber core.

It is an object of the invention to provide an arrangement of the initially mentioned type in which the spreading-away is further improved, and the winding of the spread-away fibers around the yarn core is improved still further.

This object is achieved in that the rotation body is arranged directly behind the pair of delivery rollers in such a manner that the suction device is effective into the area of the nip line, and that the suction slot has a section which extends essentially in the direction of the nip line and which is situated in the area of a deflection of the sliver leaving the pair of delivery rollers located in front of this section.

By means of this construction, it is achieved that a spreading-away of fiber ends is already obtained in the area in which the sliver has the smallest twist and thus the spreading-away can be carried out most effectively.

In a development of the invention, it is provided that the sliver leaving the pair of delivery rollers is unguided in the area of the deflection. This ensures that the spreading-away of the fiber ends is not impaired by mechanical guides, for example, resting against one of the roller surfaces of the pair of delivery rollers.

In a further development of the invention, it is provided that the rotation body is designed as a narrow roller which, by means of its circumference, projects into a wedge-shaped gap formed by the pair of delivery rollers. As a result, it becomes possible to move the shell surface of the rotation body very close to the nip line of the pair of delivery rollers. The pair of delivery rollers will then serve as an air guiding device in the area of the nip line by means of which an advantageous targeted air current is obtained which promotes the spreading-away of fiber ends.

In a further development of the invention, it is provided that the shell surface of the rotation body is driven to a circumferential speed which is higher than the delivery speed of the pair of delivery rollers and the withdrawal speed of the withdrawal device. The shell surface of the rotation body therefore moves faster than the sliver. As a result, it is achieved that the spreadaway fiber ends are moved faster than the yarn core, in which case, the fiber ends are, on the one hand, placed against the yarn core and, on the other hand, are wound around the yarn core by means of an ascent that can be determined by way of the circumferential speed of the shell surface of the rotation body, the yarn core rotating around its axis as a result of the false twist introduced by the false-twisting device and in the process sliding on the shell surface of the rotation body.

In a further development of the invention, it is provided that the rotation body is driven by means of a driving element which also drives the rotation bodies of several adjacent spinning points of a machine. Because of the axial direction of the rotation body, it is possible to provide a tangential belt extending through in the longitudinal direction of the machine for the drive of the rotation bodies.

Other objects, advantages and novel features of the present invention will become apparent from the following detailed description of the invention when considered in conjunction with the accompanying drawings.

DETAILED DESCRIPTION OF THE DRAWINGS

Figure 1:
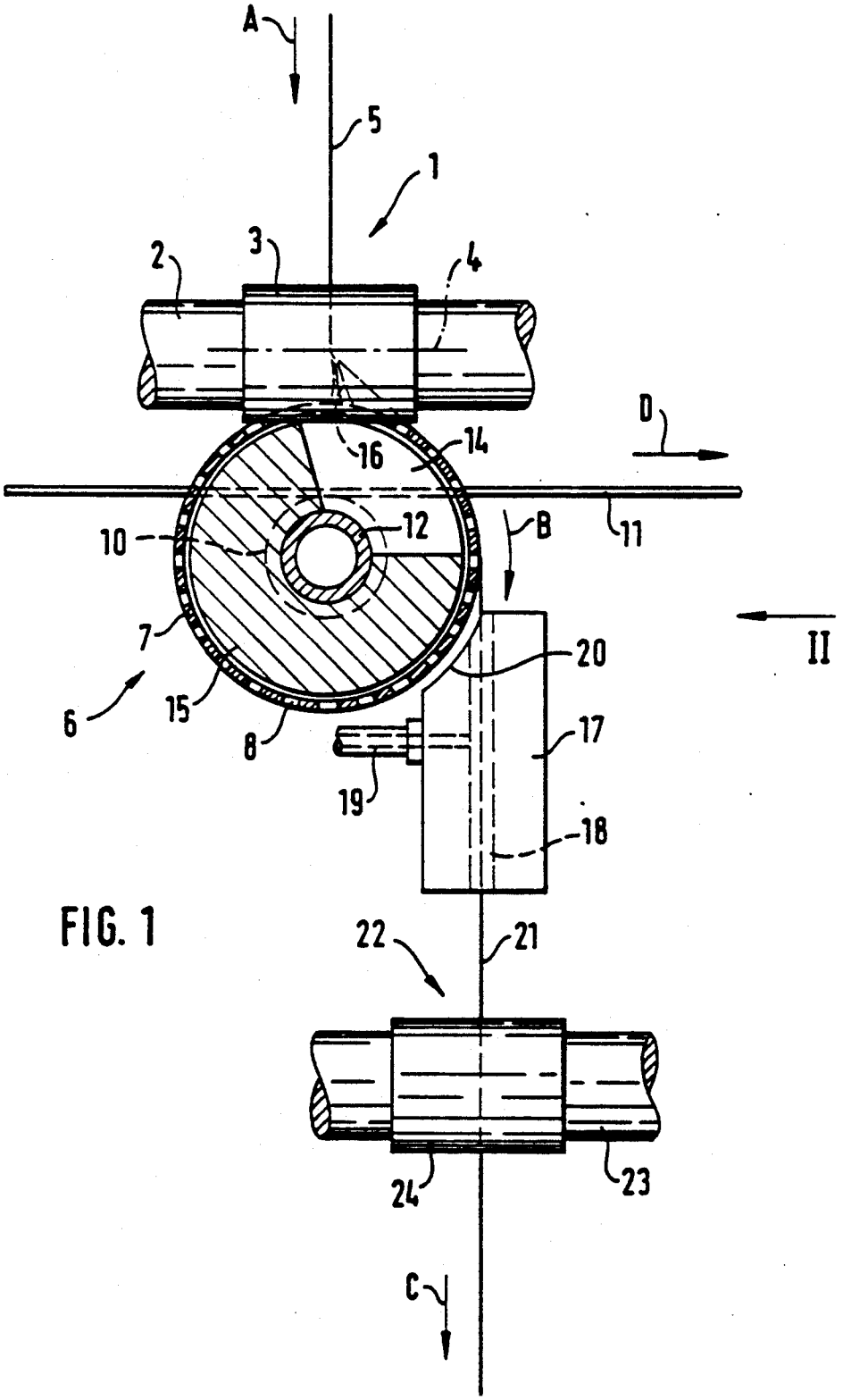
FIG. 1 is a partially sectional schematic view of an arrangement constructed according to a preferred embodiment of the invention.
Figure 2:
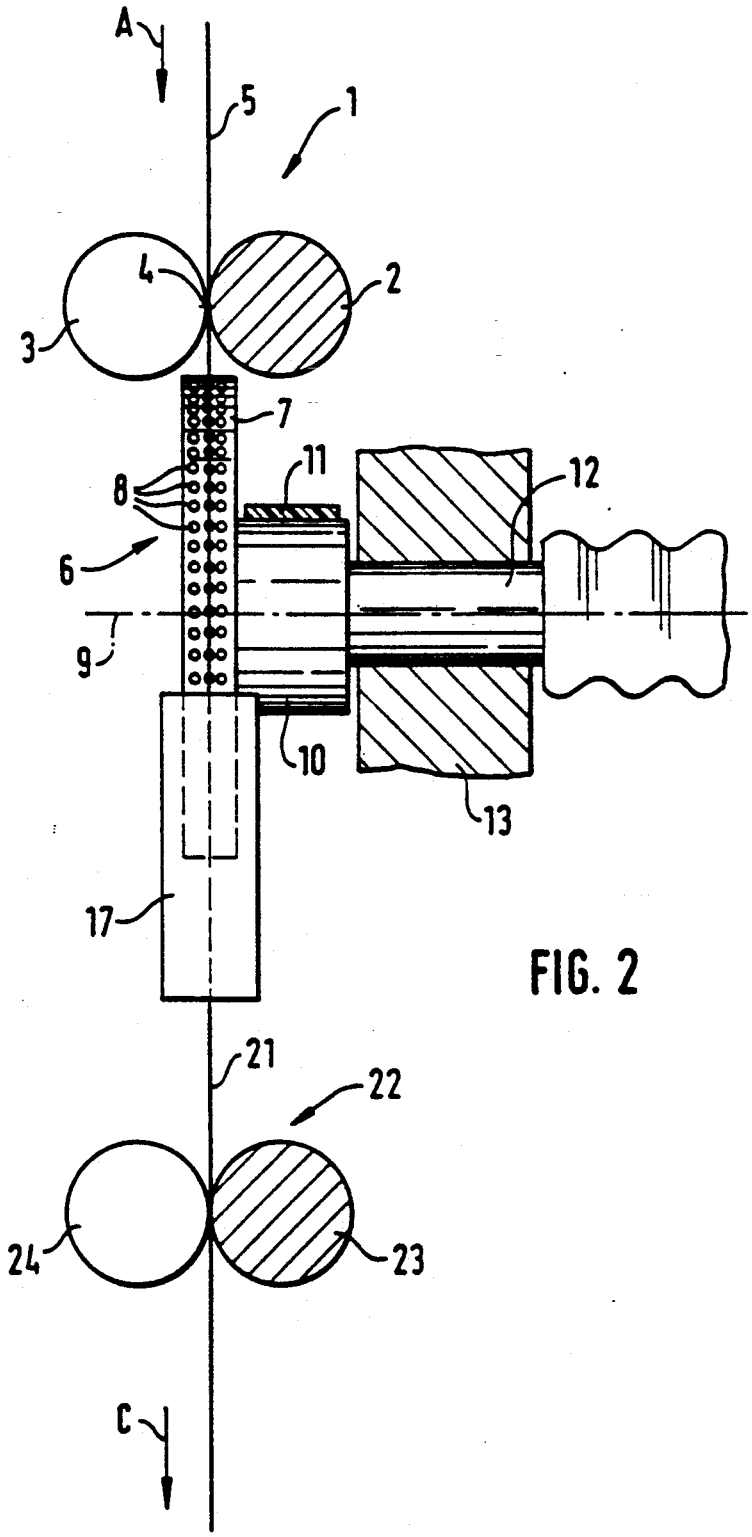
FIG. 2 is a view in the direction of the Arrow II of FIG. 1.

FIGS. 1 and 2 show an individual spinning point (only partially) of a spinning machine which is equipped with a plurality of spinning points of this type which are arranged at least on one side of the machine next to one another in a row.

Each spinning point comprises a drafting unit 1 in which a sliver travelling in the direction of the arrow (A) is drawn to the desired yarn size. Of the drafting unit, only the pair of delivery rollers is shown which comprises a bottom cylinder 2 extending through in the longitudinal direction of the machine and a pressure roller 3 which, in a spring-loaded manner, is pressed against the bottom cylinder 2 and, together with it, forms a nip line 4 for the sliver 5.

A false-twisting device 17 which is constructed as a pneumatic false-twisting nozzle is connected behind the drafting unit 1. This false-twisting nozzle which is known per se has a yarn duct 18 extending in its longitudinal direction into which several blow nozzles lead in a tangential manner which are supplied with compressed air by way of a compressed-air line 19. The pneumatic false-twisting device 17 generates a false twist, which will be discussed later, in the sliver 5 leaving the drafting unit 1 and guided in the direction of the arrow (B) to the false-twisting device 17.

Behind the false-twisting nozzle 17, the false twist opens up again so that the then existing yarn 21 has an almost untwisted yarn core and fiber ends which are wound around it. Behind the false-twisting device 17, this yarn 21 is withdrawn by means of a withdrawal device 22 which comprises a drivable cylinder 23 extending through in the longitudinal direction of the machine and a pressure roller 24. Then the yarn 21, in the direction of arrow (C), travels to a wind-up device which is not shown and by which it is wound up into a cross-wound package.

A rotation body 6 in the form of a narrow roller is arranged between the pair of delivery rollers 2, 3 of the drafting unit 1 and the false-twisting device 17. As illustrated in FIGS. 1 and 2, the axis 9 of rotation of the rotation body 6 extends perpendicularly with respect to a plane extending through the nip line 4 of the pair of delivery rollers 2, 3 which in the nip line 4 extends tangentially with respect to the rollers of the pair of delivery rollers 2, 3. This plane forms a median line with respect to the wedge-shaped gap formed by the pair of delivery rollers 2, 3 if the rollers 2, 3 have the same size.

By means of a bearing 10 which is only outlined schematically, the rotation body 6 is disposed on a shaft 12 which is held in a holding device 13. The outer circumference of the bearing 10 is constructed as a wharve by means of which the rotation body 6 is driven by means of a tangential belt 11 which travels through in the longitudinal direction of the machine in the direction of the arrow (D) and drives the rotation bodies 6 of all spinning points of one side of the machine. The axis of rotation 9 of the rotation body 6 approximately intersects the imagined extension of the path of the sliver 5 through the drafting unit 1. The false-twisting device 17 constructed as an air nozzle, by means of the air duct 18, connects tangentially to the circumference of the rotation body 6. The housing of the false-twisting nozzle is provided with a recess 20 adapted to the contour of the rotation body 6. As shown in FIG. 1, the sliver 5 leaving the pair of delivery rollers 2, 3 of the drafting unit 1 is deflected behind the nip line 4 with one component into the direction of the nip line 4 so that it travels approximately tangentially with respect to the outer circumference of the rotation body 6. The sliver 5 will then wind around the outer circumference of the rotation body 6 at an angle of slightly less than 90°.

In the interior of the rotation body 6, a suction insert 15 is arranged which is stationarily mounted on the shaft 12 and which, by means of a suction slot 14, is directed to the inner circumferential surface of the rotation body 6. The axially closed suction slot 14 extends over an angle at the circumference of approximately 90° in the area in which the sliver 5 is guided by the outer circumference of the rotation body 6 which forms a guiding surface 7. The shell of the rotation body 6 is provided with a perforation 8 so that the guiding surface 7 is air permeable. By way of the suction slot 14 and the hollow shaft 12, which is connected to a vacuum source which is not shown, an air current is therefore generated which flows into the interior of the rotation body 6.

As shown particularly in FIG. 1, the suction slot 14 of the rotation body 6 projecting into the area of the wedge-shaped gap of the pair of delivery rollers 2, 3 has a section which is directed to the nip line 4 and extends over a certain area in its longitudinal direction. In this area the sliver 5 leaving the nip line 4 of the pair of delivery rollers 2, 3 experiences a deflection after which it tangentially approaches the guiding surface 7 of the rotation body 6. Edge fibers 16 of the sliver 5 have the tendency to go along less well in this deflection than the core of the sliver 5. This tendency is promoted by the suction air current taken in by way of the suction slot 14 so that these edge fibers 16 approach the guiding surface 7 of the rotation body 6 essentially as a linear extension of the travelling direction (A) of the sliver 5. This reinforces the spreading-away of fiber ends and makes it uniform.

The rotation body 6, which is driven to perform a rotation in the travelling direction of the sliver 5 (direction of arrow B), has a circumferential speed which is higher than the delivery speed of the pair of delivery rollers 2, 3 of the drafting unit 1 and the withdrawal speed of the withdrawal device 22. The delivery speed of the drafting unit 1 and the withdrawal speed of the withdrawal device 22 which is equal to the delivery speed or slightly less determine the speed of the sliver 5 on the guiding surface 7 of the rotation body 6. Since the guiding surface 7 has a higher speed, the sliver 5 slides on the guiding surface 7.

Figure 3:
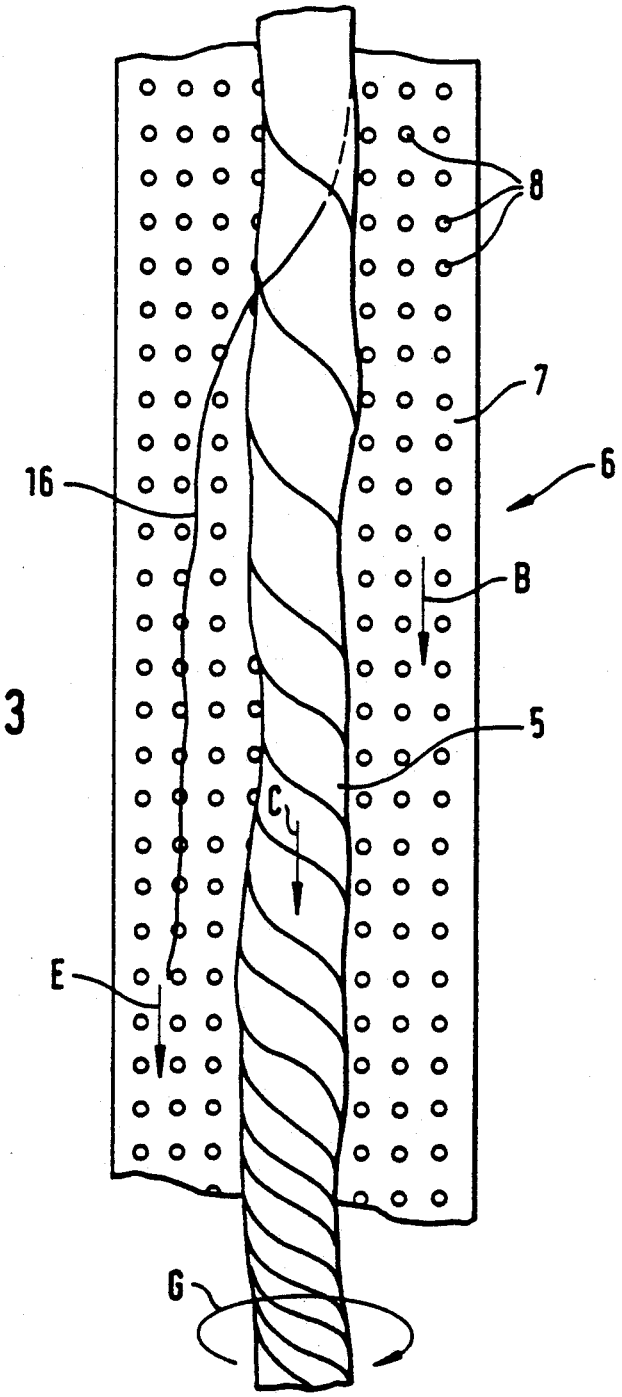
FIG. 3 is an enlarged cutout of the embodiment according to FIG. 2 for the explanation of the spinning operation.

As illustrated in FIG. 3, the false-twisting device 17 provides the sliver 5 with a twist in the direction of the arrow (G) as a result of which the sliver 5 rotates around its own axis. As also shown in FIG. 3, this twist weakens in the direction of the nip line 4 of the pair of delivery rollers 2, 3 of the drafting unit 1. Since the spread-away fiber ends 16—indicated in FIG. 3 by means of only one fiber end 16—are taken along by the guiding surface 7 largely without any sliding, they travel ahead of the core of the sliver 5, as indicated by the arrow (E). Because of the rotation in the direction of the arrow (G), however, the fiber ends 16 are simultaneously wound around the core of the sliver 5 on the outside, but the winding-around takes place in the opposite direction of the false twist provided to the core of the sliver 5 as a result of the twisting (G). After travelling through the false-twisting device 17, the false twist of the sliver 5 opens up again in which case, however, the fiber ends 16 which have not gone along in the whole false twisting or in another false twisting are wound around the sliver 5 and remain wound around the sliver 5 so that a yarn 21 is received, the strength of which is determined by the wound-around fiber ends 16. A very uniform yarn 21 is obtained because of the controlled spreading-away of these fiber ends 16 in the area directly after leaving the nip line 4 and because of the controlled winding of these fiber ends 16 around the sliver 5, while it rotates as a result of the false-twist that was provided to it.

The spreading-away of the fiber ends 16 in the area behind the nip line 4 in which a deflection of the sliver 5 takes place is also not impaired as the sliver 5 does not place itself against one of the two delivery rollers 2, 3, but extends essentially in the center in the wedge-shaped gap formed by these two rollers 2, 3. Since the sliver 5 in its core area is not to be taken along by the rotation body 6 but stays back while sliding relative to it, no perforation 8 is required in this area of the guiding surface 7. It is therefore possible to limit the perforation 8 to the areas on both sides of the travelling path along which the sliver 5 travels. It is also possible to provide the perforation 8 only on one side of this travelling path.

Although in the embodiments illustrated and described in the following, for reasons of representation, the rotation body 6 of the individual embodiments is often shown at a relatively large distance from the delivery rollers 2, 3 of the drafting units 1, it should be stated with respect to these embodiments that these rotation bodies 6 are brought as close as possible to the wedge-shaped gap formed by the delivery rollers 2, 3 so that the suction air current is as effective as possible in the area in which the sliver 5 is deflected after leaving the nip line 4 of the pair of delivery rollers 2, 3.

Figure 4:
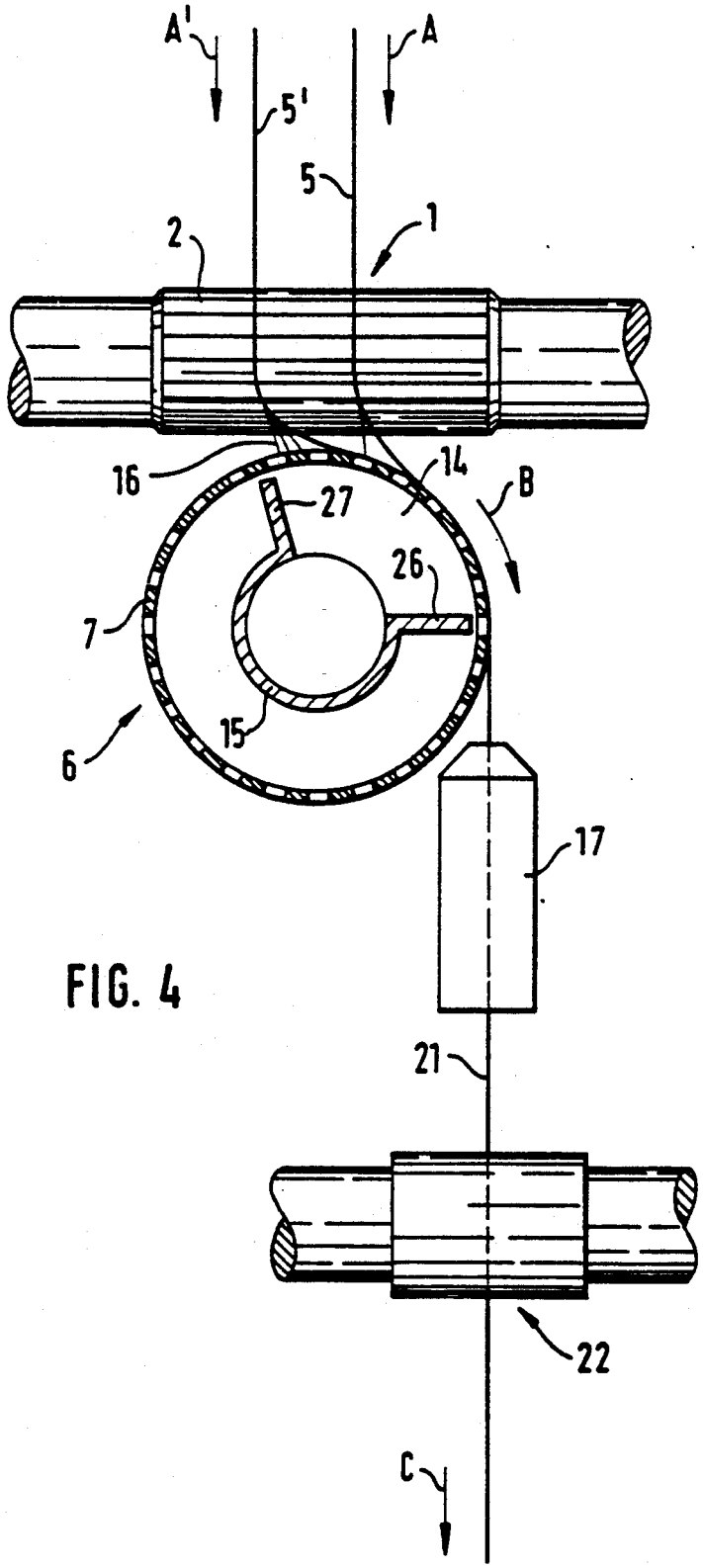
FIG. 4 is a view similar to FIG. 1 of an embodiment in which two slivers are spun and combined on the rotation body.

The embodiment according to FIG. 4 corresponds largely to the embodiment according to FIG. 1. However, the drafting unit 1 is designed in such a manner that two slivers 5, 5' exist which travel through the drafting unit 1 corresponding to the arrows (A, A'). After leaving the pair of delivery rollers 2, 3, of which the pressure roller is not shown, the two slivers 5, 5' are deflected in the above-described manner, in which case a suction air current generated by the suction device 15 by way of a suction slot 14 is effective in the area of both deflections. In the shown embodiment according to FIG. 4, the suction device 15 is constructed such that the suction slot 14 in the circumferential direction is limited to its effective area by two webs 26, 27.

The two slivers 5, 5' are guided together, that is, doubled on the guiding surface 7 of the rotation body 6. They will then travel jointly into the pneumatic false-twisting device 17. In this embodiment, the spun yarn 21 receives a certain twisted-yarn character. In this embodiment, the fiber ends 16 are at least partially wound around both slivers.

Figure 5:
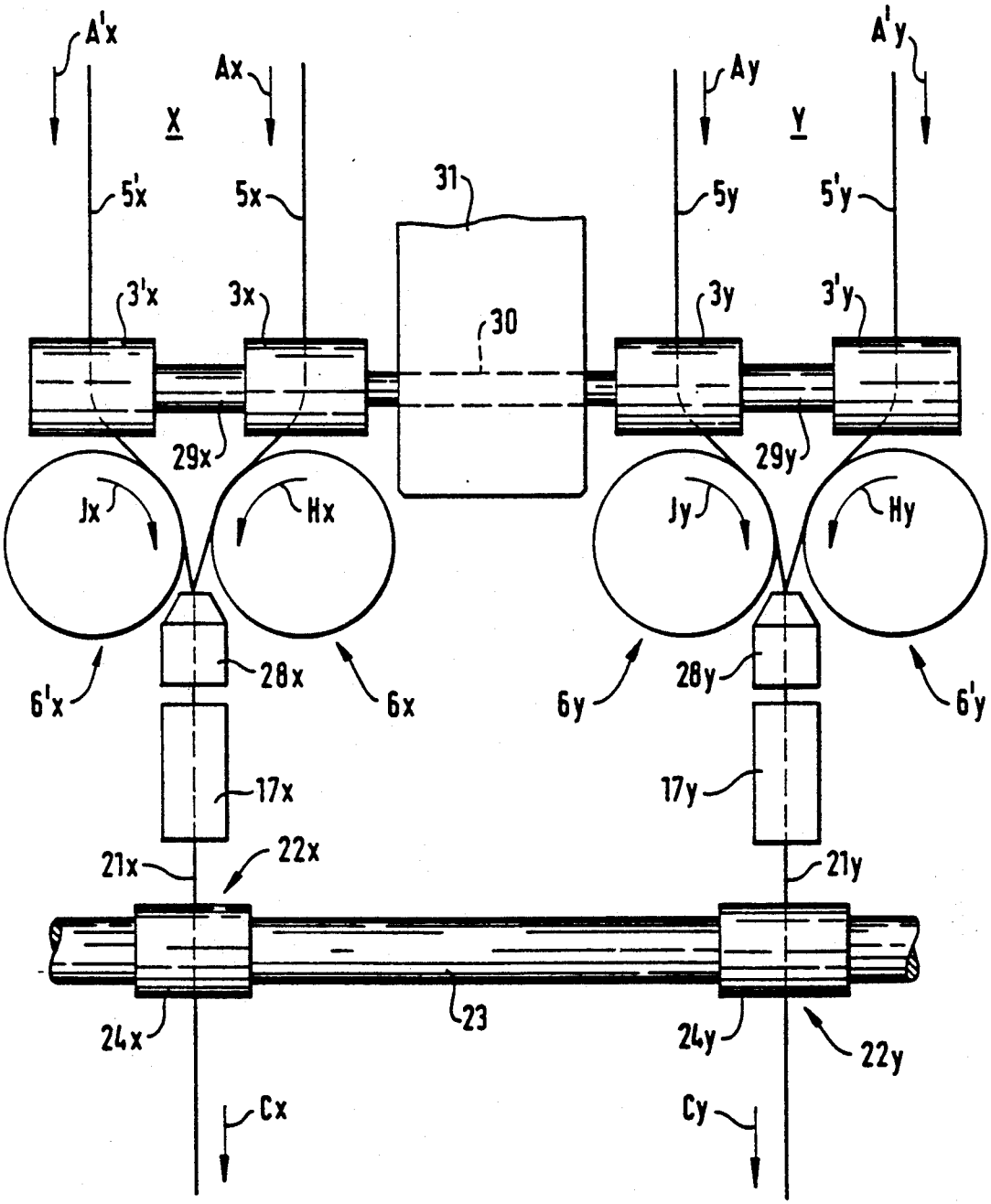
FIG. 5 is a view of an embodiment with two adjacent spinning points which produce one individual yarn respectively from two slivers, the individual yarn travelling through the false-twisting device.

In the embodiment according to FIG. 5, two spinning points (X, Y) are provided which are each again subdivided into two individual spinning points. A common load carrier 31 which receives the total of four pressure rollers 3x, 3'x, 3y, 3'y is assigned to the total of these four spinning points and thus forms a double pressure roller twin, that is, a pressure roller quadruplet. The slivers 5x, 5'x, 5y, 5'y leaving the pairs of delivery rollers travel to the rotation bodies 6'x, 6x, 6y, 6'y. The drivable bottom rollers of the drafting units 1 are not shown. The rotation bodies of two "sub"-spinning points respectively, i.e., the rotation bodies 6'x, 6x as well as 6y, 6'y rotate in the opposite direction in the direction of the arrows (Ix, Hx; Iy, Hy) in such a manner that the slivers 5x, 5'x, 5y, 5'y are guided together. Two slivers 5'x, 5x; 5y, 5'y respectively travel into a common intake nozzle 28x, 28y by which they are supplied to a common false-twisting device 17x, 17y. The thus produced yarns 21x, 21y are then withdrawn by respective common withdrawal devices 22x, 22y and are later wound into a package by a wind-up device which is not shown. Since, in the embodiment according to FIG. 5, the slivers 5'x, 5x, 5y, 5'y each travel over separate rotation bodies which ar constructed and driven corresponding to the embodiment according to FIG. 1 and 2, the winding-around of the edge fibers of the individual slivers also takes place partially independently from one another so that edge fibers wind around the subsequent yarn 21x, 21y as well as the components which form the same.

The bottom rollers of the embodiment according to FIG. 5, which are not shown, are constructed as individually drivable roller ends which are each assigned only to spinning point (X) or to spinning point (Y). As a deviation of the representation according to FIG. 5, it is provided in another embodiment that, instead of the individual pressure rollers 3x, 3'x; 3y, 3'y, one common pressure roller respectively for spinning points (X,Y) is assigned to one spinning point respectively.

Figure 6:
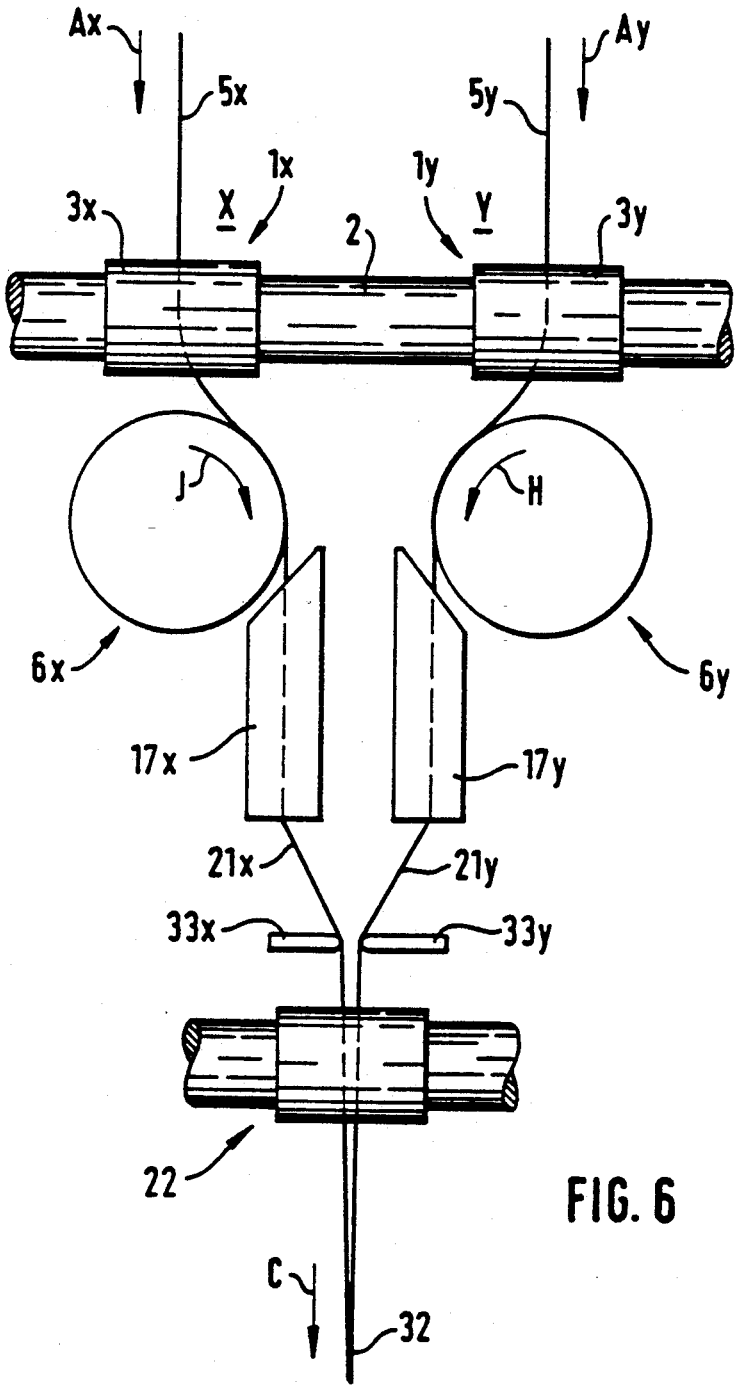
FIG. 6 is a view of an embodiment having two adjacent spinning points which each produce a yarn, these yarns being combined to a double yarn behind the false-twisting devices.

In the embodiment according to FIG. 6, two spinning points (X and Y) corresponding to the embodiment according to FIG. 1 are shown which are arranged mirror-symmetrically with respect to one another. The slivers 5x, 5y travelling through the drafting units 1x and 1y are guided by rotation bodies 6x, 6y which are driven to perform rotations in the opposite direction in the direction of the arrows (I, H). The drive may take place by means of a common belt which is deflected between the wharves of the two rotation bodies 6x, 6y in such a manner that, on the one hand, it travels on the top side and, on the other hand, on the bottom side of these wharves. The slivers 5x, 5y enter into respective separate pneumatic false-twisting devices 17x, 17y and produce yarns 21x, 21y there. These yarns are subsequently guided together to form a double yarn 32 by yarn guiding elements 33x, 33y in front of a common withdrawal device 22. In a manner not shown in detail, this double yarn 32 in this form is wound onto a package spool which is used as a feeding package for a twisting operation. In this embodiment, the two yarns 21x, 21y are only prestrengthened; i.e., are strengthened by the pneumatic false-twist spinning only to such an extent that they withstand the additional processing steps without being destroyed. It is only during the twisting which follows that the double yarn 32 receives its final yarn strength.

Figure 7:
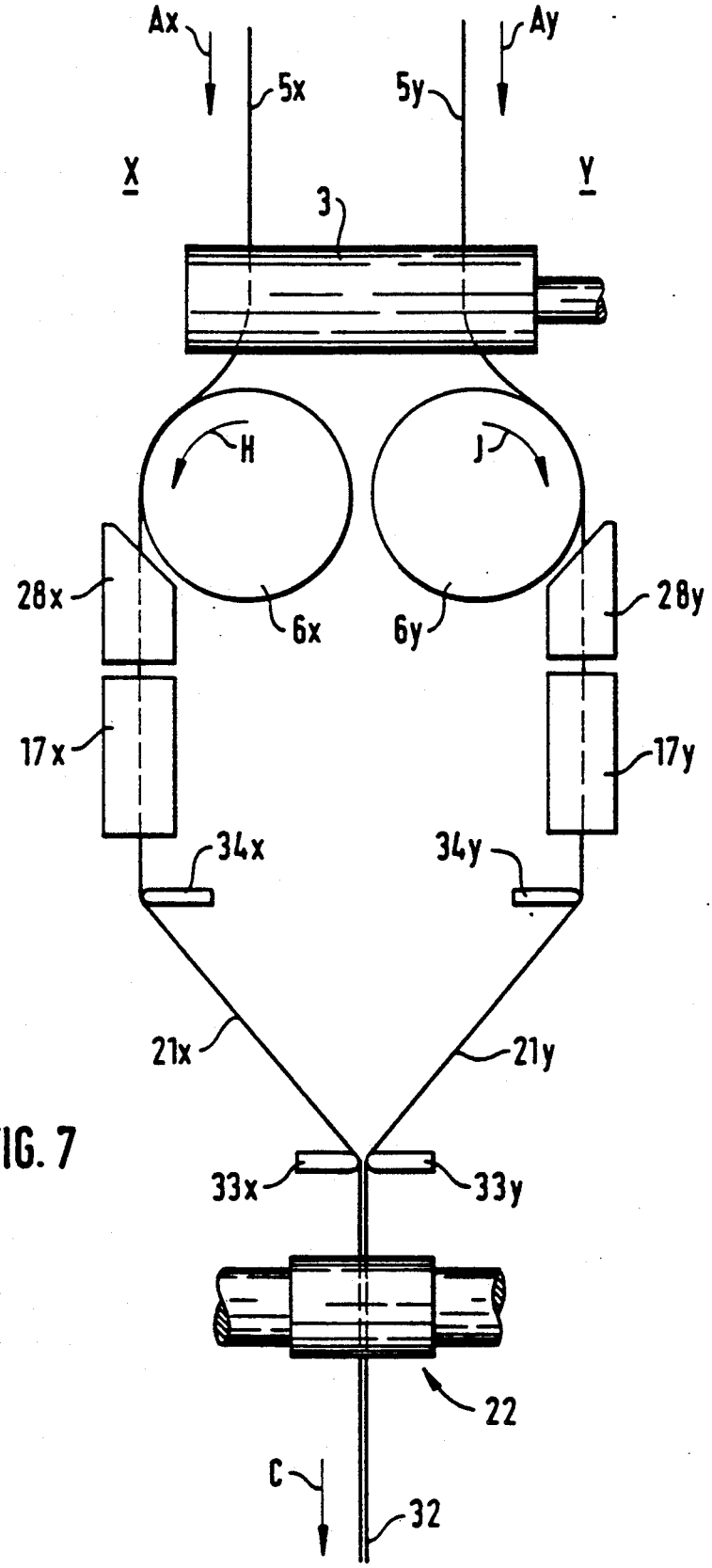
FIG. 7 is a view similar to FIG. 6 but showing an embodiment with a different arrangement of the rotation bodies.

The embodiment according to FIG. 7 in principle corresponds to the embodiment according to FIG. 6. Also in this embodiment, one individual yarn 21x, 21y respectively is produced by two spinning points (X,Y) arranged mirror-invertedly with respect to one another, these individual yarns being guided together to form a double yarn 32 and as such being withdrawn by a withdrawal device 22 and subsequently being wound onto a package spool. It is also provided in the embodiment according to FIG. 7 that the rotation bodies 6x, 6y and the false-twisting devices 17x, 17y are arranged mirror-symmetrically. However, in the embodiment according to FIG. 7, the rotating direction of the rotation bodies 6x, 6y is reversed, that is, rotation body 6x rotates counterclockwise, and rotation body 6y rotates clockwise. The two slivers 5x, 5y are therefore farther removed from one another after leaving the drafting unit 1.

In addition, it is provided in the embodiment according to FIG. 7 that an intake nozzle 28x, 28y is arranged between the false-twisting device 17x, 17y and the pertaining rotation body 6x, 6y. These intake nozzles 28x, 28y have a yarn duct which is not shown and which is provided with one or several compressed-air blow-out openings connected to a compressed-air supply line. These compressed-air blow-out openings have a slope in the travelling direction of the yarn so that an intake takes place as a result of an injection effect. These intake nozzles 28x, 28y generate no or practically no false twist.

Figure 8:
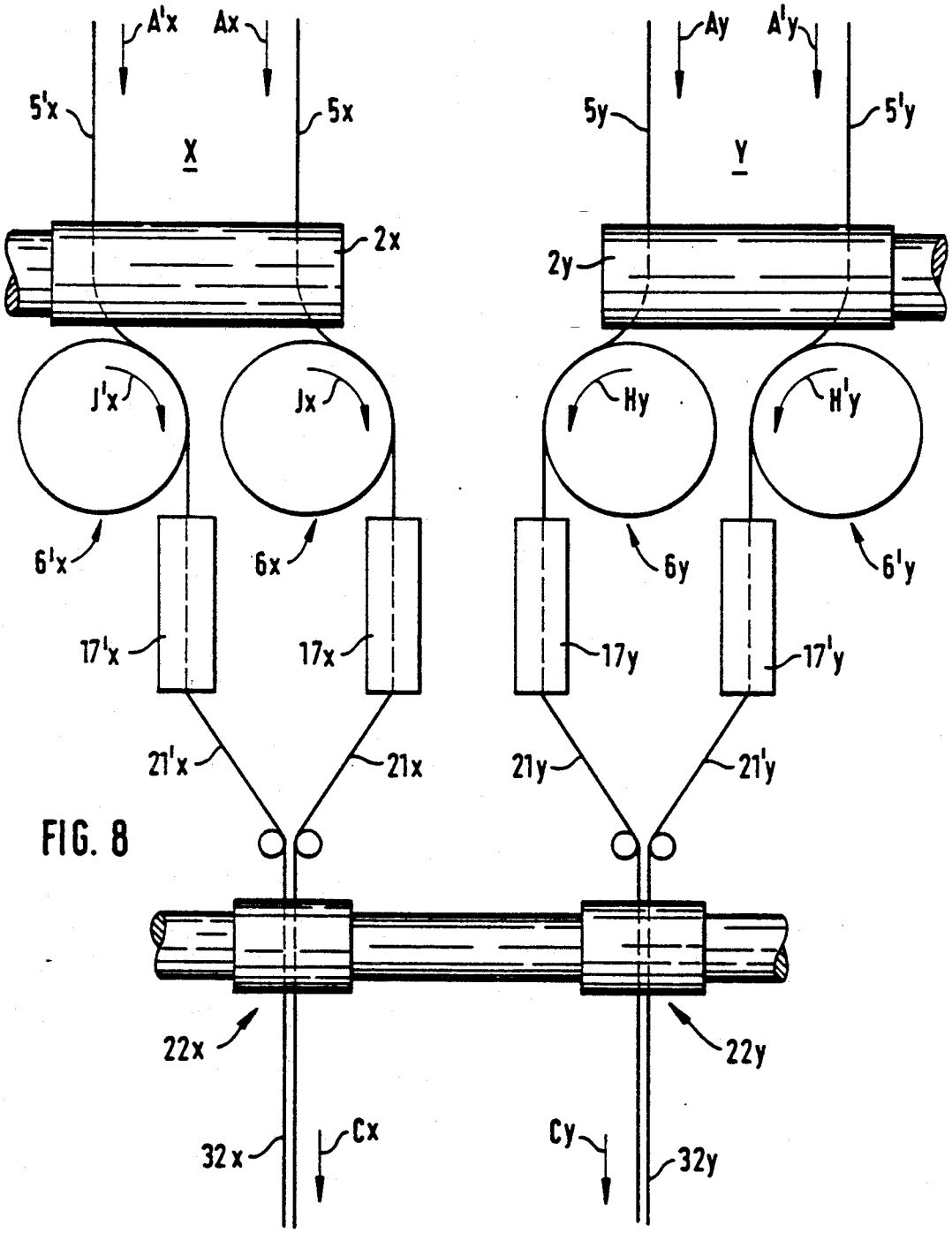
FIG. 8 is a view of another embodiment with two spinning points which each produce a double yarn and are arranged mirror-symmetrically with respect to one another.

The spinning machine which is shown in a cutout in FIG. 8 has a plurality of spinning points (X, Y) which each produce one double yarn 32x, 32y respectively which, in the direction of the arrows (Cx, Cy) is guided to a winding device which is not shown. The two spinning points (X,Y) each process two slivers 5'x, 5x; 5y, 5'y respectively which are supplied by common pairs of delivery rollers of which, in each case, only the bottom cylinder 2x, 2y is shown which is constructed as a roller end and is independently drivable and stoppable. By way of respective separate rotation bodies 6'x, 6x, 6y, 6'y, the slivers 5'x, 5x, 5y, 5'y travel to respective separate false-twisting devices 17'x, 17x, 17y, 17'y which spin individual yarns 21'x, 21x, 21y, 21'y which are only later guided together. The rotation bodies 6'x, 6x and 6y, 6'y each rotate in the same direction but those of the two spinning points (X, Y) as a whole rotate in opposite directions with respect to one another. Rotation bodies 6'x, 6x rotate clockwise in the direction of the arrows (I'x, Ix), while rotation bodies 6y, 6'y rotate counterclockwise (Hy, H'y).

Figure 9:
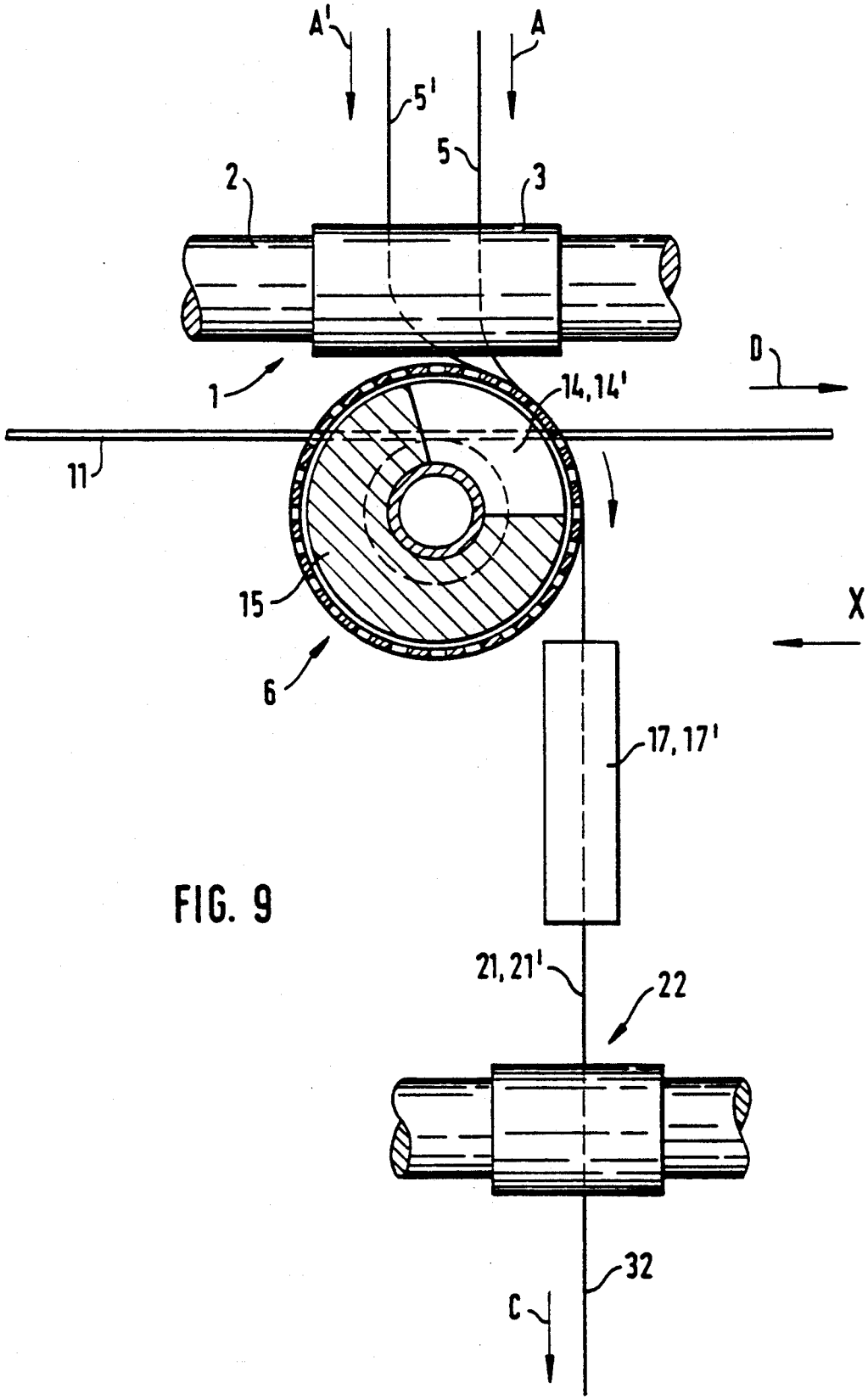
FIG. 9 is a view similar to FIG. 4 of an embodiment in which the slivers are each guided to separate false-twisting devices.
Figure 10:
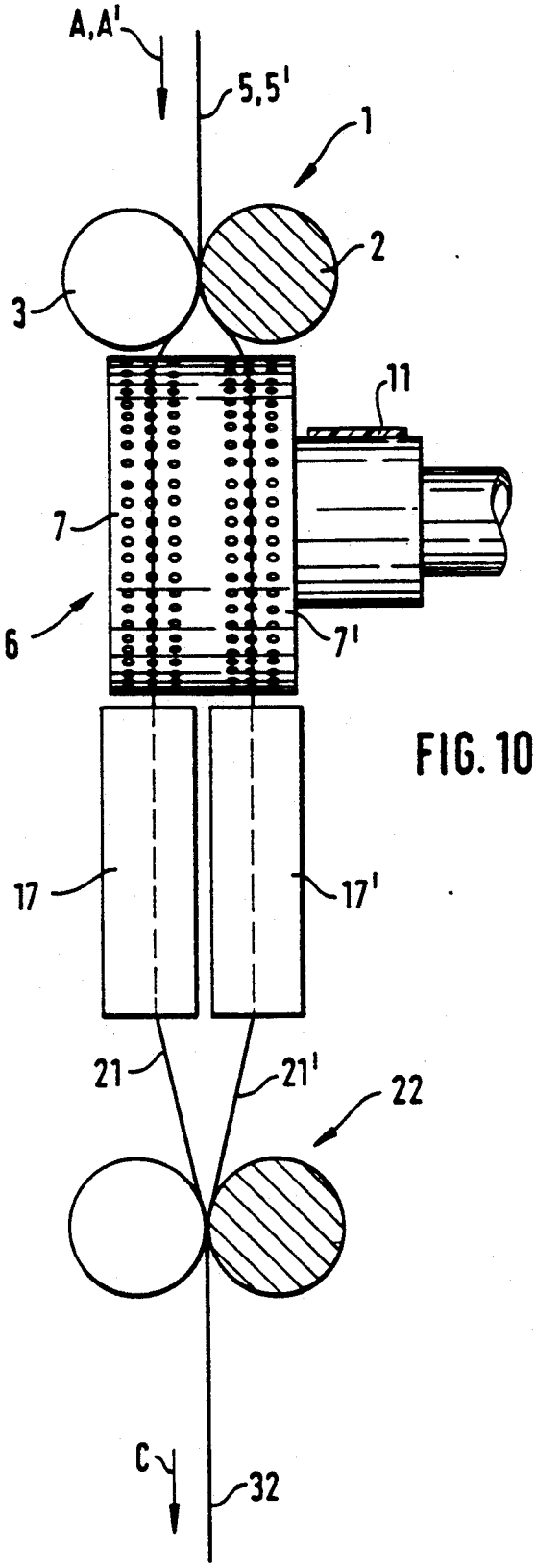
FIG. 10 is a view in the direction of arrow X of FIG. 9.

In the embodiment according to FIG. 9 and 10, two slivers 5, 5' are guided in parallel and at a distance to one another through a common drafting unit 1 in the direction of the arrows (A, A'). They then reach a common rotation body 6 which has two parallel guiding surfaces 7, 7' which are separated from one another in the axial direction of the rotation body 6. The rotation body 6 is constructed and driven corresponding to the embodiment according to FIG. 1. Corresponding to the two guiding surfaces 7, 7', it also has suction slots 14, 14' which also hold the two slivers 5, 5' separate on the rotation body 6. Subsequently, the two slivers 5, 5' are guided to separate pneumatic false-twisting devices 17, 17'; after leaving these false-twisting devices, the yarns 21, 21' are guided together and are withdrawn by a common withdrawal device 22. The double yarn 32 then travels in the direction of the arrow (C) to a winding arrangement which is not shown by which the double yarn 32 is wound into a package.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Apparatus for false-twist spinning in which ends of fibers situated at peripheral edges of a drafted sliver are spread away and are wound around the sliver when a false twist is opened up, comprising:

a drafting means defining a travelling direction for a sliver, a false-twisting means, a withdrawal means, and a drivable rotating means which is arranged upstream of the false-twisting means and which is provided with an air-permeable shell surface, said shell surface being subjected from an interior of the rotating means to suction by means of a suction means having a suction slot, an axis of rotation of the rotating means being directed substantially perpendicularly with respect to a plane extending through a nip line of a pair of delivery rollers of the drafting means, wherein a circumferential surface area of the rotating means is engaged by substantially the entire sliver to thereby deflect and guide the sliver between the drafting means and the false-twisting means, wherein the circumferential surface area of the rotating means engaged by the sliver is driven at a speed which is higher than the delivery speed of the drafting means and higher than the withdrawal speed of the withdrawal means such that yarn outer edge fibers are detached from central yarn core regions and are accelerated to a higher speed than the central yarn core regions, wherein the rotating means is arranged directly downstream of the pair of delivery rollers in such a manner that the suction means is effective up to the area of the nip line, and wherein the suction slot has a section which extends substantially in the direction of the nip line and which is situated in an area of deflection in which a sliver leaving the pair of delivery rollers is deflected.

2. Apparatus according to claim 1, wherein the sliver leaving the pair of delivery rollers is free from guide structure in the path between the delivery rollers and the rotating means.

3. Apparatus according to claim 2, wherein the rotation means is constructed as a narrow roller which by means of its circumference projects into a wedge-shaped gas formed by the pair of delivery rollers.

4. Apparatus according to claim 3, wherein the axis of rotation of the narrow roller substantially intersects an imagined extension of the travelling direction of the sliver which exists inside the drafting means.

5. Apparatus according to claim 4, wherein the shell surface of the rotating means is driven to a circumferential speed which is higher than a delivery speed of the pair of delivery rollers and a withdrawal speed of the withdrawal means.

6. Apparatus according to claim 5, wherein the rotating means is driven by means of a driving element which drives the rotating means of several adjacent spinning points of a machine.

7. Apparatus according to claim 5, wherein a common rotating means is provided for two slivers which, side-by-side, travel through a drafting means or two adjacent drafting means.

8. Apparatus according to claim 1, wherein the rotating means is constructed as a narrow roller which by means of its circumference projects into a wedge-shaped gap formed by the pair of delivery rollers.

9. Apparatus according to claim 1, wherein the axis of rotation of the rotating means substantially intersects an imagined extension of the travelling direction of the sliver which exists inside the drafting means.

10. Apparatus according to claim 1, wherein the shell surface of the rotating means is driven to a circumferential speed which is higher than the delivery speed of a pair of delivery rollers and a withdrawal speed of the withdrawal means.

11. Apparatus according to claim 1, wherein the rotating means is driven by means of a driving element which drives rotation means of several adjacent spinning points of a machine.

12. Apparatus according to claim 1, wherein said rotating means includes a common rotation body for two slivers which travel side-by-side through a drafting means or two adjacent drafting means.

13. Apparatus according to claim 12, wherein said false-twisting means includes a false-twisting device which is common to both slivers and is disposed behind the rotation body.

14. Apparatus according to claim 12, wherein the rotation body is followed by separate adjacent false-twisting means for each of the slivers.

15. Apparatus according to claim 14, wherein devices for the guiding-together of the two spun yarns are arranged between the two false-twisting means and a common withdrawal means.

16. Apparatus according to claim 15, wherein a common false-twisting device is connected behind each rotation means which is adjacent and assigned to a drafting means.

17. Apparatus according to claim 1, wherein the rotating means include rotation bodies assigned to two adjacent drafting means respectively, wherein devices are provided for the guiding-together of the two produced yarns, and wherein a common withdrawal means is assigned to the false-twisting means respectively.

18. Apparatus according to claim 1, wherein pressure rollers are provided for pairs of delivery rollers of four adjacent drafting means, which pressure rollers are in the form of double roller twins and are held by a common load carrier.

19. Apparatus according to claim 1, wherein the false-twisting means includes a false-twisting pneumatic nozzle.

20. A method of a textile spinning in which ends of fibers situated at peripheral edges of a drafted sliver are spread away and are wound around the sliver when a false twist is opened up, comprising:

drafting a sliver in a drafting unit, false twisting the sliver in a false twisting device disposed downstream of the drafting unit, and subjecting the sliver to a rotation device at a location intermediate the drafting unit and false twisting device, said rotation device including a rotation body rotatable about an axis which extends essentially perpendicularly with respect to a plane through a nip line of a pair of delivery rollers of the drafting unit, said rotation body including an air-permeable shell surface which is subjected to suction from inside the rotation device, wherein a circumferential surface area of the rotation body is engaged by substantially the entire sliver to thereby deflect and guide the sliver between the drafting unit and the false-twisting device, wherein the circumferential surface area of the rotating body engaged by the sliver is driven at a speed which is higher than the delivery speed of the drafting unit and higher than the withdrawal speed of a withdrawal device for withdrawing yarn from the false twisting device, such that yarn outer edge fibers are detached from central yarn core regions and are accelerated to a higher speed than the central yarn core regions, and wherein the rotation body is arranged directly downstream of the pair of delivery rollers in such a manner that the suction device is effective into the area of the nip line, and wherein a suction slot of the rotation body has a section which extends essentially in the direction of the nip line and which is situated in the area of a deflection of the sliver leaving the pair of delivery rollers which is located in front of this section.

21. A method according to claim 20, wherein the sliver leaving the pair of deliver rollers is free from guide structure path between the delivery rollers and the rotating body.

22. A method according to claim 21, wherein the rotation body is constructed as a narrow roller which by means of its circumference projects into a wedge-shaped gap formed by the pair of delivery rollers.

23. A method according to claim 22, wherein the axis of rotation of the rotation body substantially intersects the imagined extension of the travelling direction of the sliver which exists inside the drafting unit.

24. A method according to claim 23, wherein the shell surface of the rotation body is driven to a circumferential speed which is higher than a delivery speed of the pair of delivery rollers and a withdrawal speed of the withdrawal device.

25. A method according to claim 20, wherein the rotation body is constructed as a narrow roller which by means of its circumference projects into a wedge-shaped gap formed by the pair of delivery rollers.

26. A method according to claim 20, wherein the axis of rotation of the rotation body substantially intersects the imagined extension of the travelling direction of the sliver which exists inside the drafting unit.

27. A method according to claim 20, wherein the shell surface of the rotation body is driven to a circumferential speed which is higher than a delivery speed of the pair of delivery rollers and a withdrawal speed of the withdrawal device.

28. A method according to claim 20, wherein the false-twisting device includes a false-twisting pneumatic nozzle.

29. An arrangement for false-twist spinning comprising:

a drafting unit for drafting sliver, at least one false-twisting device arranged downstream of the drafting unit for false-twisting sliver to form a yarn, a withdrawal device arranged downstream of the at least one false-twisting device, and a guiding element which is arranged between the drafting unit and the false-twisting device, said guiding element being driven to perform rotations around an axis disposed transversely with respect to the yarn travelling direction, said guiding element forming a deflection with a yarn guiding surface moving in the travelling direction of the yarn and configured to cause relative sliding movement of the yarn on the yarn guiding surface, wherein the guiding surface is driven at a speed which is higher than the delivery speed of the drafting unit and higher than the withdrawal speed of the withdrawal device such that yarn outer edge fibers are detached from central yarn core regions and are accelerated to a higher speed than the central yarn core regions, and wherein said axis of said guiding element extends substantially perpendicularly to a plane through a nip line of a pair of delivery rollers of the drafting unit.

30. An arrangement according to claim 29, wherein said at least one false twisting device include a false-twisting nozzle.

31. An arrangement according to claim 29, wherein the guiding element is provided with an air permeable shell surface, said shell surface being subjected from an interior of the guiding element to suction by means of a suction device having a suction slot, wherein the suction slot has a section which extends substantially in the direction of the nip line and which is situated in an area of deflection in which a sliver leaving the pair of delivery rollers is deflected.

32. A method of manufacturing spun textile yarn comprising:

drafting sliver at a drafting unit, false-twisting the drafted sliver using at least one false-twisting device arranged downstream of the drafting unit to form a yarn, withdrawing the yarn using a withdrawal device arranged downstream of the at least one false-twisting device, and applying deflecting forces to the drafted sliver by a guiding element which is arranged between the drafting unit and the false-twisting device, said guiding element being driven to perform rotations around an axis disposed transversely with respect to the yarn travelling direction, said guiding element forming a deflection with a yarn guiding surface moving in the travelling direction of the yarn and configured to cause relative sliding movement of the yarn on the yarn guiding surface, wherein the guiding surface is driven at a speed which is higher than the delivery speed of the drafting unit and higher than the withdrawal speed of the withdrawal device such that yarn outer edge fibers are detached from central yarn core regions and are accelerated to a higher speed than the central yarn core regions, and wherein said axis of said guiding element extends substantially perpendicularly to a plane through a nip line of a pair of delivery rollers of the drafting unit.

33. An arrangement according to claim 32, wherein said at least one false twisting device include a false-twisting nozzle.

34. An arrangement according to claim 32, wherein the guiding element is provided with an air permeable shell surface, said shell surface being subjected from an interior of the guiding element to suction by means of a suction device having a suction slot, wherein the suction slot has a section which extends substantially in the direction of the nip line and which is situated in an area of deflection in which a sliver leaving the pair of delivery rollers is deflected.

* * * * *